US006540025B2

(12) United States Patent
Scott et al.

(10) Patent No.: US 6,540,025 B2
(45) Date of Patent: Apr. 1, 2003

(54) HYDRAULICALLY METERED TRAVEL JOINT METHOD

(75) Inventors: Gordon K. Scott, Dallas, TX (US); Phillip T. Thomas, Lewisville, TX (US); Ralph H. Echols, III, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/003,568

(22) Filed: Oct. 24, 2001

(65) Prior Publication Data

US 2002/0092653 A1 Jul. 18, 2002

Related U.S. Application Data

(62) Division of application No. 09/452,047, filed on Nov. 30, 1999, now Pat. No. 6,367,552.

(51) Int. Cl.[7] ..... E21B 23/02
(52) U.S. Cl. ..... 166/355; 166/338
(58) Field of Search ..... 166/355, 338, 166/381, 242.1, 242.6, 242.7

(56) References Cited

U.S. PATENT DOCUMENTS 3,842,914 A * 10/1974 Mott ..... 166/377
4,693,316 A * 9/1987 Ringgenberg et al. ..... 166/355
5,158,142 A * 10/1992 Miszewski et al. ..... 166/237
5,419,399 A * 5/1995 Smith ..... 166/377
5,568,836 A * 10/1996 Reid ..... 166/237
5,823,264 A * 10/1998 Ringgenberg ..... 166/355

FOREIGN PATENT DOCUMENTS

WO WO 95/33912 * 12/1995

* cited by examiner

*Primary Examiner*—David Bagnell
*Assistant Examiner*—John Kreck
(74) *Attorney, Agent, or Firm*—David W. Carstens

(57) ABSTRACT

Initially, a set of locking lugs lock an inner mandrel is locked in position with respect to an outer mandrel. Unlocking the travel joint is accomplished by applying a constant vertical or downward force on the tubing string. That vertical force is transmitted through the tubing string to the outer mandrel, which causes hydraulic pressure with a hydraulic chamber to increase. When the hydraulic pressure exceeds a pressure threshold, a pressure sensitive valve opens, and the hydraulic fluid gradually flows into a reserve hydraulic chamber, allowing the outer mandrel to move with respect to the inner mandrel. A viscosity independent flow restrictor limits the transfer of hydraulic fluid to a preset flow rate. After sufficient hydraulic fluid has been received into the reserve chamber, the outer mandrel aligns with the locking lugs, which then move from the locked position to the unlocked position. The travel joint then releases, allowing the outer mandrel to telescope inward and outward.

9 Claims, 13 Drawing Sheets

200

A
A'
202
204
206
208
210
212
214
216
218
220
222
224
230
232
233
234
235
236
238
240
242
602
604

702

802

200

902

HYDRAULICALLY METERED TRAVEL JOINT METHOD

This is a divisional application for the invention disclosed in non-provisional application Ser. No. 09/452,047 filed on Nov. 30, 1999, now U.S. Pat. No. 6,367,552.

BACKGROUND OF THE INVENTION

1. Technical Field

The present invention relates to travel joints used in subterranean wells. More particularly, the present invention related to reusable travel joints. Still more particularly, the present invention relates to a reusable travel joint able to be reliably activated in highly deviated wellbores.

2. Description of the Related Art

Drilling rigs supported by floating drill ships or floating platforms are often used for offshore well development. These rigs present a problem for the rig operators in that ocean waves and tidal forces cause the drilling rig to rise and fall with respect to the sea floor and the subterranean well. This vertical motion must be either controlled or compensated while operating the well. FIG. 1A depicts a typical offshore rig operation involving ship 102, which supports rig 104. Without compensation, such vertical movement would transmit undesirable axial loads on a rigid tubing string within well casing string 106, which is extended downwardly from ship 102. This problem becomes particularly acute in well operations involving fixed bottom hole assemblies, such as the packers depicted in box 110 and further depicted in FIGS. 1B and 1C.

In the depicted example, packer 112 has been previously set in casing string 106. As is known in the art, packer 112 includes a receiving orifice for connection with a packer stinger located at the bottom of tubing 114. The connecting operation, or "stinging in" requires that tubing 114 apply an amount of force for makeup depending on the particular packer. Different mechanisms exist for stinging in, such as a "J-latch" connection, which requires rotational force to latch the "J" or a force actuated latch which uses vertical force from tubing 114. When seals within the packer are in place against the stinger, the stinger is fixed in place.

Once the stinger is in place, any vertical movement from the ship or platform will create undesirable downward and upward forces on packer 112 or may cause premature failure of components or may sting out the stinger from packer 112. What is needed is a means to compensate for the movement of the drilling ship or platform. Normally, the solution has been to place a travel joint in the tubing string, which compensates for the movement of rig 104 by axial telescoping action, as depicted in FIGS. 1B and 1C.

FIG. 1B illustrates travel joint 116 in the latched or locked position, that is a position that allows the rig operators to apply the force needed to sting in packer 112. Travel joint 116 is unlocked by different means, depending on the type of locking mechanism. One type of locking mechanism uses a shear pin that is forcibly sheared when the travel joint is unlocked. The shear pin is used to prevent the travel joint from inadvertently unlocking. One problem with this design is that the travel joint can only be unlocked once and then must be re-dressed with a new shear pin prior to subsequent use. Another type of locking mechanism uses a "J-latch" similar to that described above, is used for stinging into a packer. While this mechanism allows travel joint 112 to be locked and unlocked a number of times without re-dressing the travel joint, it has the disadvantage in that the type of packer must be considered prior to using a J-latch type travel joint. This is so because of the possibility of inadvertently stinging out of the J-latch packer that requires a similar rotational force as unlocking the travel joint. In a related packer consideration problem, certain packers allow the stinger to freely rotate within the packer, and those packers may not transmit the needed rotational resistance for unlocking or locking the J-latch on the travel joint. Therefore, the travel joint may not unlock, or worse, may not lock back in position. The benefits derived from having a travel joint in a tubing string can only be realized if the travel joint can be reliably unlocked from the surface.

FIG. 1C illustrates travel joint 116 in the unlocked position with tubing 114 telescoping into both travel joint 116 and upper tubing 118. After travel joint 116 is unlocked, the travel joint and upper tubing 118 may be telescoped over tubing 114. Lower tubing 114 may be a lighter weight than upper tubing 118 and use flush joint connections 120 which do not increase the exterior diameter of tubing 114, allowing travel joint 116 and tubing 118 to be telescoped over more than a single joint of tubing. However, as a general rule, the first joint of lower tubing 114 will be a machined joint custom manufactured for use with travel joint 116.

Another problem common to both of the above-described locking mechanisms is premature unlocking in highly deviated wellbores. In offshore drilling operations it is routine to drill a number of wells from a single platform. Each well is directionally drilled to a target location in the zone of interest, which may be a lengthy horizontal distance from the platform itself. Therefore, during a trip into the well, the wellbore string slides, or is pushed, along the inner wall of casing 106 rather than merely being lowered in the center of casing 106. Significant forces build up, which oppose the wellbore string's being lowered into the wellbore, which may unlock travel joint 116 prior to the stinger being seated in packer 112. Once unlocked, it is virtually impossible to sting into packer 112 without re-locking the travel joint. This may require an additional trip out of the well to re-dress the travel joint.

Still another problem is the uncertainty as to whether a premature unlocking has taken place. Using a prior art type travel joint, no accurate means is available for gauging whether a travel joint has become unlocked. Often the first indication that the travel joint is in the unlocked position manifests itself when the stinger will not sting into the packer. At that point, the entire well string must be completely removed from the wellbore, reset or re-dressed, and then run in again with the hope that the travel joint will not unlock again. Therefore, a wireline collar locator is often run into the wellbore to confirm that the travel joint is locked and the lower tubing is in place.

Still another problem with prior art travel joints involves the hard release inherent in the shear pin locking means. Conventionally, after a bottom hole assembly is first stung into a packer, tubing weight is applied across the travel joint, severing the shear pin, and unlocking the travel joint. Prior art shear pin-type travel joints unlock hard due to the energy stored in the tubing being released when the shear pin severs. In highly deviated wells, or wells with known tight spots, higher shear pin strengths are necessary because of the possibility of premature pin breakage. The higher the shear rating on the pin, the more stored up energy in the tubing to be released when the pin shears. This may cause damage to the tubing hanger or seat if the two make contact when the travel joint unlocks. A collar locator is often run on wireline prior to stinging into the packer to conform tubing spacing and lessen the chance of hanger or seat damage.

Further, by eliminating the wireline intervention to verify the travel joint location there is a significant reduction in the risk associated with such operations, namely the breakage of the wireline, the risk of fishing in the wellbore, and damage to the seal bore, nipple seal, nipple bore, and other inner diameter restrictions in the wellbore.

It would be advantageous to provide a smooth release travel joint which eliminated the need for a wireline depth determination. It would be advantageous to provide a travel joint with a reliable re-locking means. It would also be advantageous to provide a travel joint with a reliable locking and unlocking means for highly deviated wells. It would be further advantageous to provide the operator with an indication that the travel joint has become unlocked.

SUMMARY OF THE INVENTION

In accordance with a preferred embodiment of the present invention, the travel joint disclosed within includes a hydraulically metered locking and unlocking mechanism for engaging and disengaging inner mandrel locking lugs. Initially, a set of locking lugs lock an inner mandrel in locked position with respect to an outer mandrel. Unlocking the travel joint is accomplished by applying a constant vertical or downward force on the tubing string at a predetermined downhole or vertical force. That vertical force is transmitted through the tubing string to the outer mandrel, which causes hydraulic pressure within a hydraulic chamber to increase. When the hydraulic pressure within the chamber exceeds a pressure threshold, a pressure sensitive valve opens, and the hydraulic fluid gradually flows into a reserve hydraulic chamber, allowing the outer mandrel to move with respect to the inner mandrel. A viscosity independent flow restrictor limits the transfer of hydraulic fluid to a preset flow rate. After sufficient hydraulic fluid has been received into the reserve chamber, the outer mandrel aligns with the locking lugs, which then move from the locked position to the unlocked position. The locking mechanism in the travel joint then releases, allowing the collapse of the travel joint, wherein the outer mandrel freely travels over the inner mandrel. Thereafter, the outer mandrel may freely and telescopically move in relation to the inner mandrel upon the application of compressional or torsional forces on the string. Additionally, the travel joint may be fully extended and re-locked upon the application of sufficient tension on the string. Accordingly, the travel joint may be repeatedly locked and re-locked as needed.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 1A:
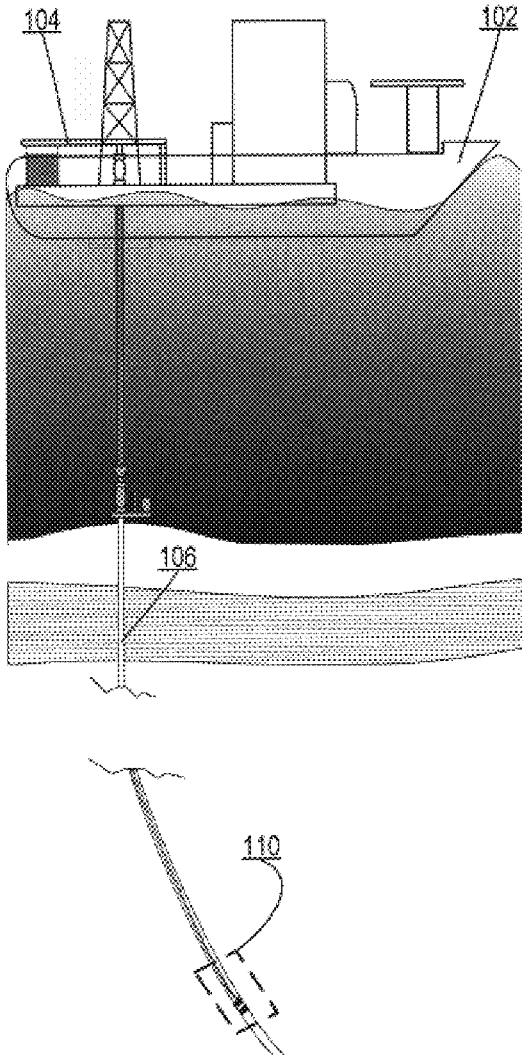
Prior Art Figure 1A
FIG. 1A depicts a typical offshore rig operation involving a ship which supports a rig.
Figure 1B:
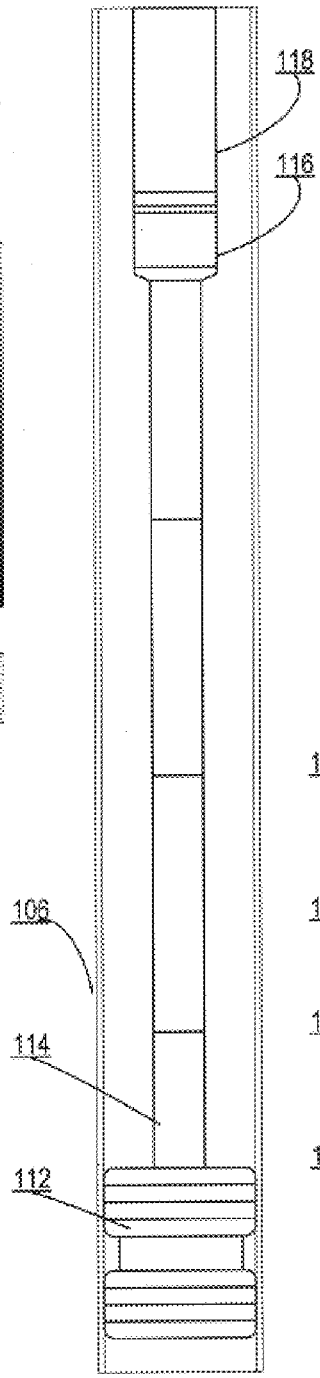
Prior Art Figure 1B
FIG. 1B illustrates a travel joint in the locked position, that is a position that allows the rig operators to apply the force needed to sting in a packer.
Figure 1C:
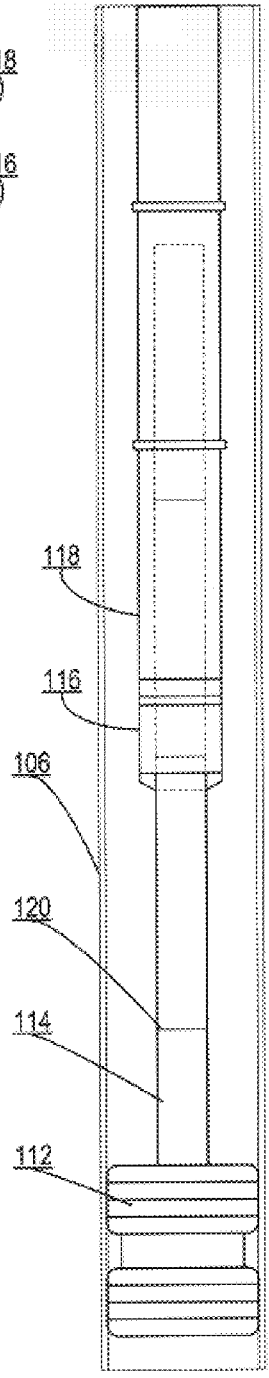
Prior Art Figure 1C
FIG. 1C illustrates a travel joint in the unlocked position with tubing telescoping into both the travel joint and the tubing.
Figure 2A:
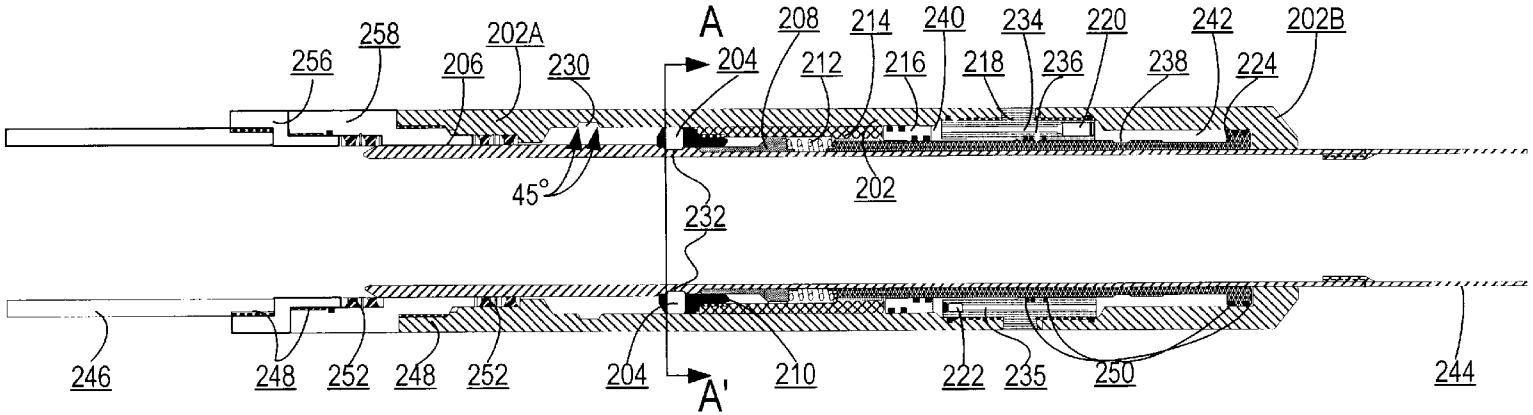
FIGS. 2A through 2C depict a hydraulically metered travel joint in accordance with a preferred embodiment of the present invention.
Figure 2C:
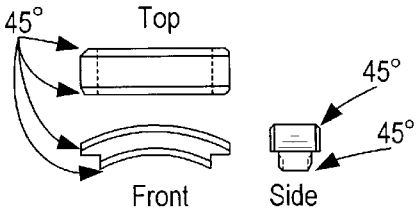
Figure 2B:
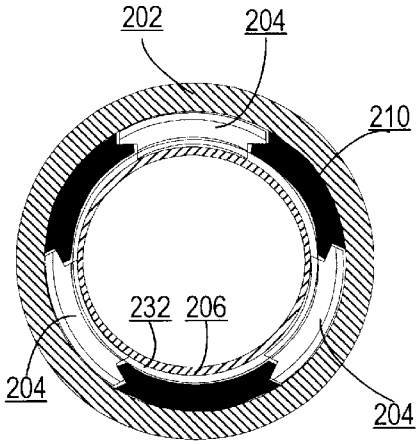

FIGS. 2A through 2C depict a hydraulically metered travel joint in accordance with a preferred embodiment of the present invention. Unlike the predecessor travel joints discussed above with respect to the prior art, the preferred embodiment of the present invention depicted as travel joint 200 includes a hydraulic chamber for control of the locking and unlocking mechanism. Unlocking the travel joint is accomplished by applying a constant vertical or downward force on the tubing string. That vertical force is transmitted through the tubing string to the outer mandrel causing pressure to be applied across a hydraulic piston. The hydraulic pressure slowly bleeds off, allowing locking lugs situated between the outer mandrel and the inner mandrel to move from the locked position to the unlocked position. Once unlocked, the travel joint telescopes in and outward similarly to the travel joints discussed above in the prior art. Other benefits of the present invention will become apparent as the figures related to a hydraulically metered travel joint are discussed.

Travel joint 200 is positioned in the tubing string between upper tubing 246 and lower tubing 244, as discussed above with respect to the prior art. In reference to the present invention, the terms "upper" and "lower" are reference terms, which indicate a component's relative position to travel joint with respect to the surface end of the string and its relative position to the travel joint with respect to the bottom assembly of the string, respectively. Lower tubing 244 joints may be connected by means of flush joint internal threads in order to be received within travel joint 200, but generally the is no need to telescope more that the first joint within the travel joint. Therefore, the first joint of lower tubing 114 is a precision machined joint, which may be repeatedly telescoped within the body of travel joint 200 without damaging the travel joint's inner wall, seals, or locking/unlocking mechanism. Travel joint 200 itself consists of outer mandrel 202, which is mechanically connected to upper tubing 246 by means of common pipe threads, through adapter subassemblies 256 and 258. Seals 252 are provided between adapter 258 and inner mandrel 206 and between outer mandrel 202 and inner mandrel 206 for dampening shock during unlocking and for isolating the fluid within inner mandrel 202 from fluid external to outer mandrel 206. From external appearances, outer mandrel 202 looks as if it consists of three components, upper outer mandrel 202A, pressure block 218 and lower outer mandrel 202B. However, for the purpose of describing the functionality of travel joint 200, upper outer mandrel 202A and lower outer mandrel 202B will be referred to as outer mandrel 202. Lower tubing 244 is threaded to the bottom end of inner mandrel 206.

For ease of understanding a preferred embodiment of the present invention, travel joint 200 comprises four assemblies: outer mandrel 202; inner mandrel 206; a pressure block assembly; and an engaging/disengaging assembly. Outer mandrel 202 and inner mandrel 206 were described briefly above. The pressure block assembly controls the flow of hydraulic fluid between upper hydraulic chamber 240 and lower hydraulic chamber 242. The pressure block assembly comprises pressure block 218, pressure relief and restrictor valve 220, unlock channel 234, pressure relief port 236, lock channel 235, check valve 222, and a plurality of o-rings 250 used for hydraulically isolating the pressure block assembly. In a preferred embodiment of the present invention, pressure relief and restrictor valve 220 is a viscosity independent, pressure activated restrictor valve such as currently available from the Lee Co., 2 Pettipaug Rd., PO Box 424, Westbrook, Conn. 06498-0424. Pressure relief and restrictor valve 220 comprises a pressure sensitive valve that requires a threshold pressure be overcome before hydraulic fluid will flow across the valve. Once threshold pressure is exceeded, a steady rate of flow is achieved regardless of the viscosity of the hydraulic fluid. A steady rate of flow translates into a steady and predictable rate of movement for outer mandrel 202. The predictable rate of outer mandrel movement leads to a predictable time for unlocking the travel joint. A typical hydraulic fluid suitable for the purposes described herewithin is a high grade automatic transmission fluid (ATF) available at any automotive parts retailer. However other hydraulic fluids may be used, such as silicon fluids and the like, which are known and used by those of ordinary skill in the art.

The final assembly is the engaging/disengaging assembly whose primary function is to engage and disengage locking lugs 204 in the locked or unlocked positions. In addition to locking lugs 204, the engaging assembly includes lug carrier 210, which is threaded onto lug carrier connector 214, which is in turn threaded to transfer piston 224. Set screws may be included for securing the threaded components in position and ensuring that the connected components do not loosen during operation. Mechanically cooperating with lugs 204 and lug carrier 210 are lug support 208 and support spring 212. Finally, the engaging assembly includes floating piston 216 and inner and outer o-rings 250. Floating piston 216 is disposed in a radial cavity created laterally by the inner wall of outer mandrel 202 and the outer wall of transfer piston 224, with the upper and lower extents defined by the lower portion of lug carrier connector 214 and the upper portion of pressure block 218, respectively. It is important to note that the upper portion of floating piston 216 does not fill the entire void of the radial cavity and remains proximate to the lower portion of lug carrier connector 214. Upper hydraulic chamber 240 is thereby formed from the unused portion of the radial cavity described above. Hydraulic fluid contained in upper hydraulic chamber 240 is hydraulically isolated by a plurality of o-rings 250 shown in FIG. 2A. In a preferred embodiment of the present invention, floating piston 216 is not physically connected to either transfer piston 224 or lug carrier connector 214. This allows floating piston 216 to move at a slightly different upward rate than transfer piston 224 and lug carrier connector 214. The different rate of movement compensates for air in the hydraulic chambers and for matching the precise displacement of volume transferred from lower hydraulic chamber 242. Lower hydraulic chamber 242 is defined laterally by the inner wall of outer mandrel 202 and the outer wall of transfer piston 224, and its upper and lower extents are defined by the lower portion of pressure block 218 and an upper facing portion of transfer piston 224, respectively. Hydraulic fluid contained in lower hydraulic chamber 242 is also hydraulically isolated by a plurality of o-rings 250 shown in FIG. 2A.

The four assemblies discussed immediately above cooperate to lock and unlock inner mandrel 206 from the remainder of travel joint 200. In the locked position, inner mandrel 206 is locked in position within the axial annular space of the inner wall of outer mandrel 202. Hence, the interior diameter of outer mandrel 202 is sufficient to allow the exterior diameter of both inner mandrel 206 and lower tubing 244 to freely move in the vertical motion, telescoping, once travel joint 200 is unlocked. To prevent inner mandrel 206 from undesired telescoping within outer mandrel 202, locking lugs 204 are radially spaced around the outer diameter of inner mandrel 206 and within the inner diameter of outer mandrel 202. When travel joint 200 is in the locked position, lugs 204 are received within locking slot 232.

In a preferred embodiment of the present invention, locking slot 232 is a chamfered channel or slot, radially machined within inner mandrel 206. Locking slot 232 is of sufficient size to accept a portion of locking lugs 204. In the unlocked position, locking lugs 204 are partially accepted within locking slot 232. Release slot 230 is a chamfered channel or slot that is radially machined within the inner wall of outer mandrel 202 and of sufficient size to partially accept locking lugs 204. Both locking slot 232 and release slot 230 are machined with forty-five degree chamfered edges at the bottom of the respective slots, rather than the slot walls directly meeting the slot bottoms at a ninety-degree angle.

Turning now to FIG. 2C, front, top, and side views of locking lug 204 are depicted. Note that each edge of locking lug 204 that contacts a forty five-degree chamfer, is itself beveled at a corresponding forty five-degree angle. The combination of the beveled lugs and chamfered slots allows for reliable engaging and disengaging of the lugs and slots with little tendency of hanging up during locking/unlocking operation. This configuration allows the shearing force on lugs 204, caused by axial forces applied to outer mandrel 202 and inner mandrel 206, to be redirected as a radially inward or radially outward force on lug 204, sufficient to move lugs 204 from release slot 230 or locking slot 232, respectively.

In a preferred embodiment of the present invention, three locking lugs are used for locking and unlocking travel joint 200, as depicted in FIG. 2B. However, any number of locking lugs may be used without unnecessarily restricting the operation of the present invention. Locking lugs 204 are positioned at regular angles around inner mandrel 206 and held in those precise radial angles by lug carrier 210. Lug carrier 210 contains a number of lug grooves equal to the number of lugs employed in the travel joint. The purpose of the lug grooves in lug carrier 210 is to maintain the proper orientation of lugs 204 with respect to locking slot 232 and release slot 230. Lug carrier 210 rides on inner mandrel 206 and lug support 208.

FIG. 2B is a diagram showing a radial cutaway view taken at section A–A'. Note that in the present locked position, lugs 204 are situated against the inner wall of outer mandrel 202 and within locking slot 232 machined into inner mandrel 206. Lug carrier 210 is situated between the interior diameter of outer mandrel 202 and the exterior diameter of inner mandrel 206. As will be seen by the following figures, the axial alignment of lugs 204 is provided by lug carrier 210, while the radial position of lugs 204 is determined by the position of locking slot 232 and release slot 230 relative to lugs 204.

The description of travel joint 200 is an exemplary preferred embodiment and not to be construed as the only embodiment. Those of ordinary skill in the art will readily understand that alternatives may be substituted for the components described above without departing from the scope of the invention.

In accordance with a preferred embodiment, radially expanding keys or lugs are provided for locking and unlocking. However, one of ordinary skill in the art would understand that locking could also be achieved by a series of collets, which are free to flex (or deflect) into similar locking recesses. The collets would also be supported and unsupported in the same manner as the locking keys in the preferred embodiment. Similarly, a snap ring system or series of snap rings could also be used, which would be free to flex (or deflect) into similar locking recesses. The snap rings would also be supported and unsupported in the same manner as the locking lugs in the preferred embodiment.

Also in accordance with a preferred embodiment of the present invention, hydraulic metering (delay) is accomplished by using a pressure relief and restrictor valve or a series of proprietary restricting valves, which allow restricted flow in one direction and virtual free flow in the opposite direction. These restrictions provide for the required 'time delay' during operation. Built into these proprietary restricting valves is a relief mechanism that will permit flow only when a predetermined threshold pressure is reached.

One of ordinary skill in the art would realize that time delay can also be provided by restricting single direction flow by providing an elastomeric seal designed to leak at a very slow rate can be provided for restricting fluid flow. In this case no restricting valves would be required. A second alternative is by using a series of accurately sized orifices of very small diameter placed in the fluid transfer block (typically, but not limited to, a radial orientation) designed to permit fluid bypass at a very slow rate would also server as a fluid restrictor. In this case no restricting valves would be required. Finally, a very small annular bypass area that would allow fluid bypass at a very slow rate could be used. In this case no restricting valves or seals (preventing flow through the bypass section at least) would be required.

As to a free flow state, one of ordinary skill in the art would realize that free flow can also be accomplished (in one direction) by a commonly available, ball-style check-valve where the ball is typically biased against its seat with a form of spring. The ball can be metallic or thermoplastic. Another option for facilitating free flow in one direction is by proving a commonly available, poppet-style check-valve where the poppet is biased against its seat with a form of spring. The poppet can be metallic or thermoplastic. Another option is a commonly available, flap-style check-valve where the flap mechanism is biased against its seat with a form of spring. The flap mechanism can be metallic or thermoplastic.

Alternatives for a single direction relief valve threshold pressure are similar to those used for achieving free flow state, such as a ball-style check-valve; a poppet-style check-valve; or a flap style check-valve, each of which are described above.

In accordance with a preferred embodiment, the present invention utilizes a transfer chamber using a floating piston to maintain a hydrostatic pressure balance (in the transfer piston chambers) with the well pressure inside and outside the travel joint locking mechanism assembly. This floating piston also accommodates fluid thermal expansion, as well as fluid volume tolerance during loading of the chambers with hydraulic fluid. Other embodiments utilize a U-cup style piston seal. This single section seal would straddle the gap between the seal bore ID and seal shaft ID thus replacing the piston and o-rings currently shown in the preferred embodiment. Another alternative embodiment includes the use of V-packing piston seals. This single section multi-stack sealing arrangement would also straddle the gap between the seal bore ID and seal shaft ID thus replacing the piston and o-rings currently shown in the preferred embodiment.

The inner and outer housing (that make up the overall body of the travel joint) are fixed relative to one another by means of the locking mechanism and hydraulic time delay system. In a preferred embodiment, the maximum stroke of the travel joint is determined by the length of the outer tube above the outer housing of the travel joint mechanism and the length of the inner tube below the inner housing of the travel joint mechanism. The inner and outer connecting tubes are suitably sized joints of oilfield tubing/casing, which use a flush joint tubing thread to avoid undesirable upsets. Artisans skilled in the art would realize that other alternatives by which travel joint stroke can also be accomplished. For instance, suitably sized upset joints of tubing/casing above and below the travel joint mechanism, which use may be joined by straight, tapered, buttress, modified buttress, or proprietary premium thread joints. Also, suitably sized one-piece components (other than purchased oilfield tubulars) manufactured to lengths necessary for the desired travel joint stroke. Here connecting joints may or may not be required.

In the preferred embodiment, a temporary seal is achieved by use of several robust molded seals. This seal is bi-directional and is necessary for the purpose of a rudimentary pressure test prior to travel joint release and space-out. This seal mechanism may also be unidirectional, as required. The seal in the preferred embodiment is temporary. That is, once the locking mechanism has released the inner and outer housings, the seals no longer provide pressure containment. However, during stroke-out or space-out a continuous seal is also possible. Continuous or temporary, BI or unidirectional sealing can also be accomplished by: elastomeric or non-elastomeric o-rings; elastomeric or non-elastomeric multi-stack v-packing; elastomeric or non-elastomeric U-cups; and/or specialized premium seals (such as proprietary non-elastomeric brands and metal seals).

FIGS. 3 through 10 depict the cooperation of components comprising travel joint 200 during locking and unlocking operations. FIGS. 3A and 3B depict travel joint 200 in the fully locked position. In the fully locked position, lugs 204 are completely seated within locking slot 232, as can be seen in FIG. 3A or in cutaway section A–A' shown in FIG. 3B. Lug carrier 210 is situated between the interior diameter of outer mandrel 202 and the exterior diameter of inner mandrel 206, and lugs 204 are radially disposed between lug grooves formed in lug carrier 210. A lug support is pressed firmly against locking slot lower shoulder 233 due to support spring 212 being in the fully compressed position, which exerts the maximum upward force possible. Floating piston 216 is in the lowermost position possible, which reduces the volume of upper hydraulic chamber 240 to the minimum. Conversely, lower hydraulic chamber 242 has the maximum capacity possible. However, rather than completely filling lower chamber 242 with hydraulic fluid, the amount of hydraulic fluid is used in slightly less than the capacity of lower chamber 242 in order to compensate for thermal expansion in the wellbore. The lower extent of the chamber has been increased due to the position of transfer piston 224 being in the lowermost possible position.

In the fully locked position, hydraulic fluid in the upper and lower hydraulic chambers is static. Dynamic flow from lower hydraulic chamber 242 to upper hydraulic chamber 240 can only occur when the pressure inside the lower hydraulic chamber exceeds the pressure threshold of pressure relief and restrictor valve 220. Pressure is increased within lower hydraulic chamber 242 by downward force on travel joint 200 being applied though the connected tubing. Such force causes outer mandrel 202 and pressure block 218 to move downward with respect to transfer piston 224 and the remaining components of travel joint 200. Once the pressure within lower hydraulic chamber 242 exceeds the threshold pressure of pressure relief and restrictor valve 220, flow occurs from the lower chamber to the upper chamber via unlock channel 234.

The pressure threshold may be changed, thereby adjusting the force required to unlock the travel joint, by substituting pressure relief and restrictor valves. Pressure relief and restrictor valves vary depending on their preset pressure threshold. The operation of the pressure relief and restrictor valve can be checked by placing the entire travel joint between hydraulically operated rams and noting the pressure needed to actuate unlocking. Alternatively, the hydraulic pressure within lower hydraulic chamber 242 may be increased via an external hydraulic connection port (not shown) in lower chamber 242. Flow is detected at a similar external hydraulic connection port (not shown) in upper chamber 240 when the pressure exceeds the threshold pressure for pressure relief and restrictor valve 220. The external ports are also used for filling the hydraulic chambers with fluid.

Figure 3A:
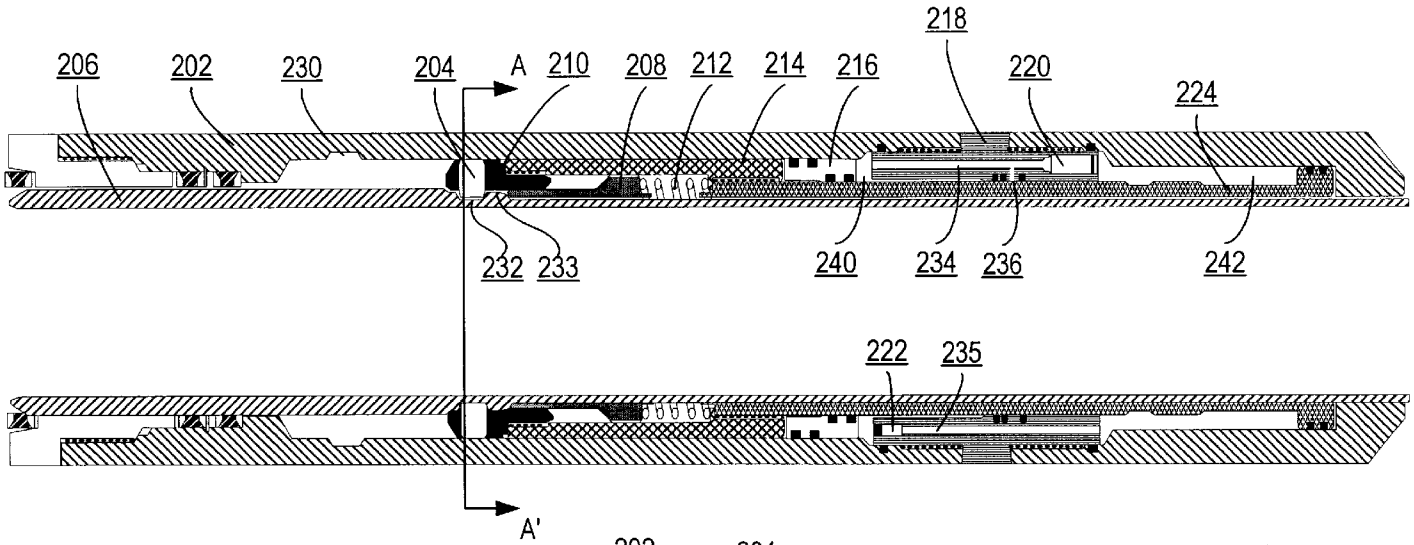
FIGS. 3A and 3B depict a travel joint in the fully locked position.
Figure 3B:
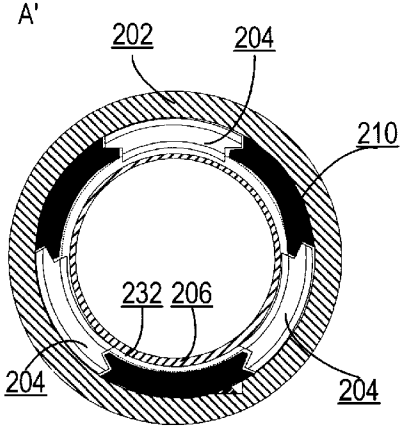

FIG. 3B is a diagram showing a radial cutaway view taken at section A–A'. Travel joint 200 is in the fully locked position. Lugs 204 are firmly between the inner wall of outer mandrel 202 and inner mandrel 206, filling locking slot 232. Lug carrier 210 is situated between the interior diameter of outer mandrel 202 and the exterior diameter of inner mandrel 206.

Figure 4A:
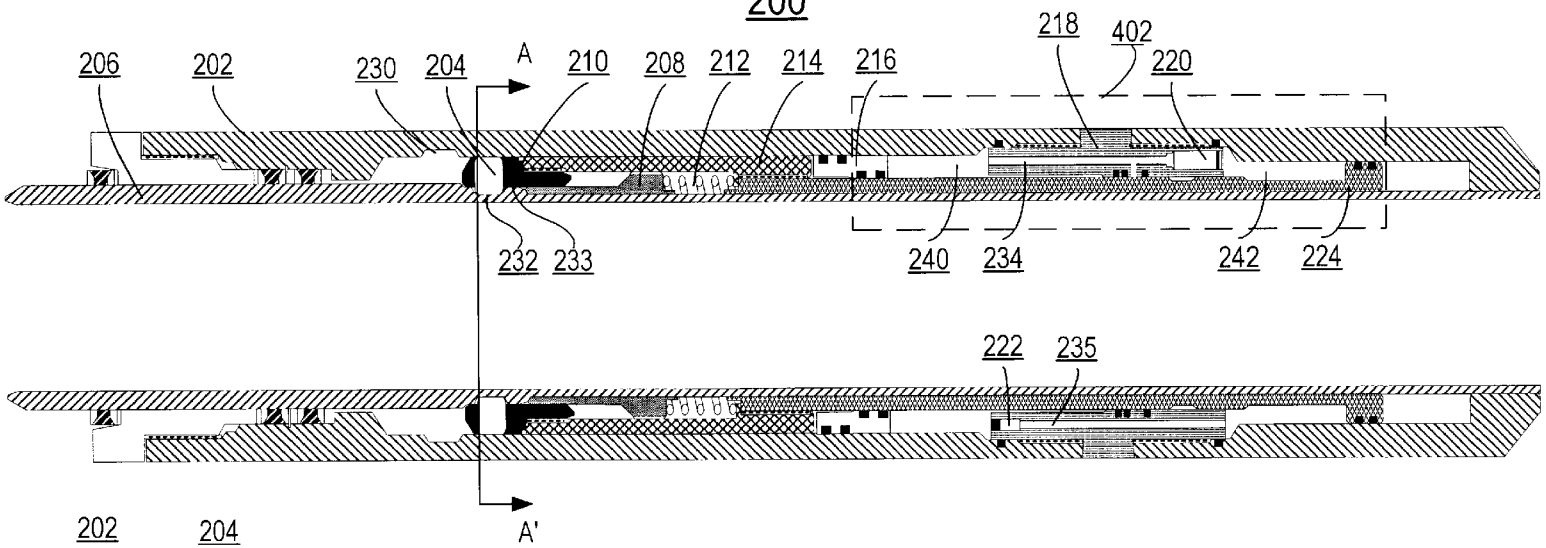
FIGS. 4A through 4C depict a travel joint in an intermediate unlocking position.
Figure 4C:
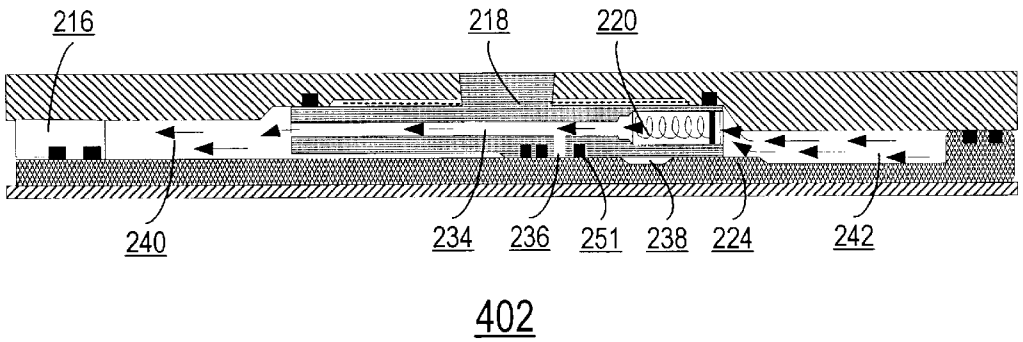
Figure 4B:
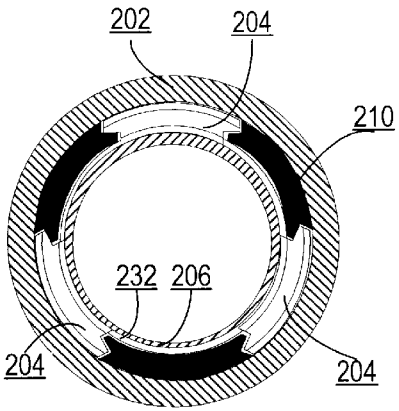

FIGS. 4A through 4C depict travel joint 200 in an intermediate unlocking position. After the downward force on travel joint 200 is sufficient to cause the hydraulic pressure within lower hydraulic chamber 242 to exceed the preset pressure threshold of pressure relief and restrictor valve 220, outer mandrel 202 moves down with respect to its fully locked position. Once the threshold pressure is exceeded, the hydraulic fluid slowly flows into upper chamber 240 at a predetermined steady rate, which is determined by the selection of pressure relief and restrictor valve. The steady rate of flow translates into a steady and predictable rate of movement for outer mandrel 202, and a predictable time for unlocking the travel joint. The hydraulic section is contained in box 402 and magnified in FIG. 4C.

The path of hydraulic fluid flow is depicted in FIG. 4C as arrows from lower hydraulic chamber 242 to upper hydraulic chamber 240. As outer mandrel 202 and pressure block 218 move downward with respect to transfer piston 224, fluid in lower hydraulic chamber 242 is forced through pressure relief and restrictor valve 220 into unlock channel 234 and finally into upper hydraulic chamber 240. Note that in the process, pressure relief slot 238 in transfer piston 224 is brought closer to pressure relief port 236 in pressure block 218. In the present position, however, pressure relief slot 238 is isolated from pressure relief port 236 by lower o-ring 251. Floating piston 216 moves upward at a corresponding distance from pressure block 218 because floating piston 216 is not physically connected to either transfer piston 224 or lug carrier connector 214. This allows floating piston 216 to move at a slightly different rate to compensate for air in the hydraulic chambers and for matching the precise displacement of fluid volume from lower hydraulic chamber 242.

Returning to FIG. 4A, note that the position of lugs 204 is much closer to release slot 230 than in the previous figure, FIG. 3A. However, support spring 212 remains fully compressed, thereby forcing lug support 208 solidly against locking slot lower shoulder 233. As can be seen from cutaway section A–A' depicted in FIG. 4B, travel joint 200 is still in the locked position, preventing inner mandrel 206 from telescoping into the upper tubing. Lugs 204 still remain firmly between the inner wall of outer mandrel 202 and inner mandrel 206, filling locking slot 232.

FIGS. 5A through 5D depict travel joint 200 in another intermediate unlocking position. Outer mandrel 202 continues to move downward with respect to the other components in travel joint 200. Hydraulic fluid flows into upper chamber 240 and remains at a steady rate, with the lower end of pressure block 218 moving closer to the lower end of transfer piston 224, thereby continuing to reduce the volume of lower hydraulic chamber 242. The hydraulic section is contained in box 504 and is magnified in FIG. 5C.

Figures 5A, 5B, 5C, 5D:
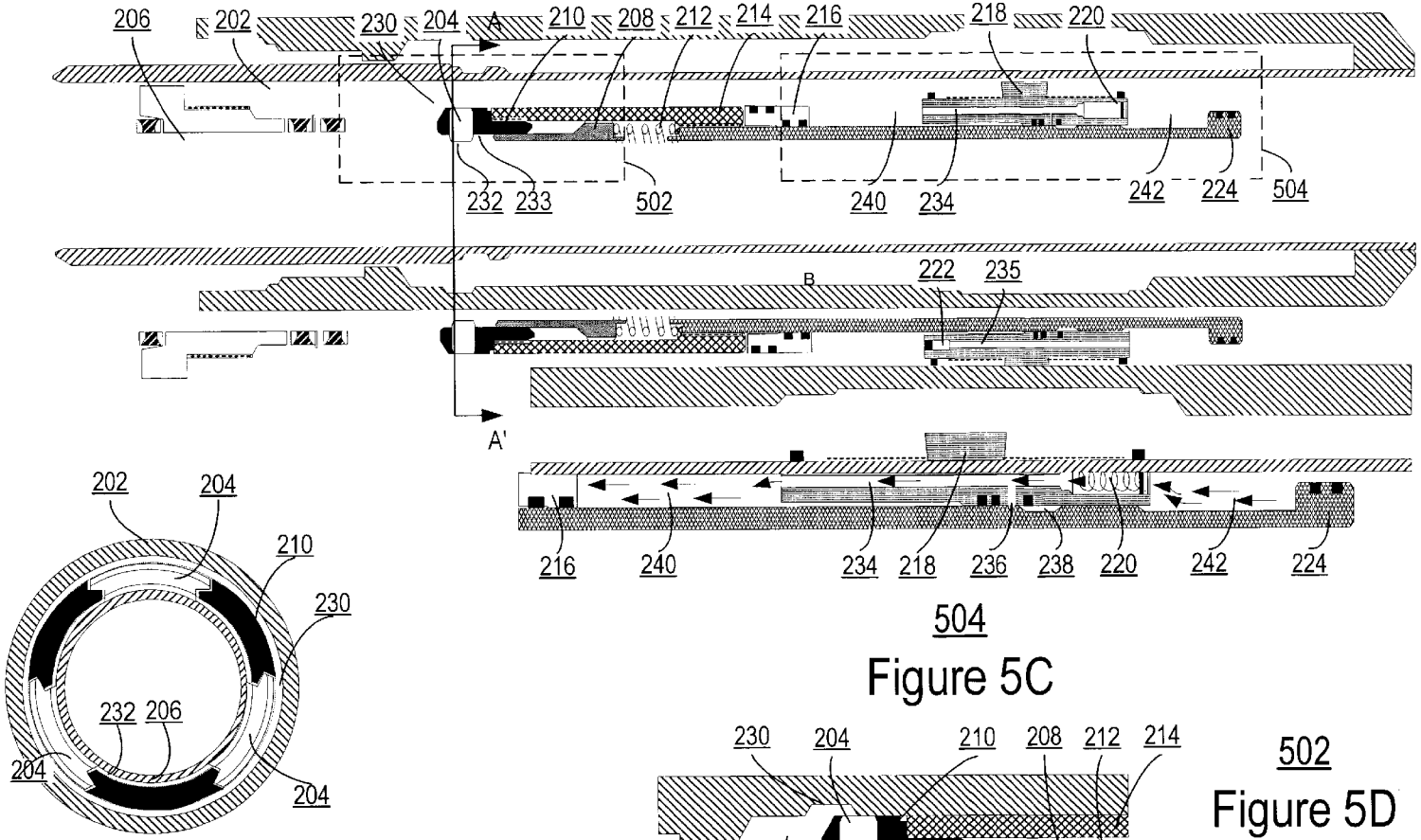
FIGS. 5A through 5D depict a travel joint in another intermediate unlocking position.

Turning to FIG. 5C, the path of hydraulic fluid flow is again depicted as arrows from lower hydraulic chamber 242 to upper hydraulic chamber 240. Outer mandrel 202 and pressure block 218 continue to move downward with respect to transfer piston 224, and the volume of lower hydraulic chamber 242 continues to be reduced. Hydraulic fluid flows into upper hydraulic chamber 240 from lower hydraulic chamber 242 causing floating piston 216 to maintain its position relative to transfer piston 224 and lug carrier connector 214. Note that pressure relief slot 238 is now positioned across the lowermost o-ring on pressure block 218, but not yet across pressure relief port 236. The seal provided by that o-ring has now lost some hydraulic fluid that may be escaping from lower hydraulic chamber 242 directly into relief port 236, thereby circumventing the flow across pressure relief and restrictor valve 220.

Returning to FIG. 5A, box 502, including the engagement/disengagement mechanism (lug 204, lug carrier 210, lug carrier connector 214, transfer piston 224, and floating piston 216), is magnified in FIG. 5D. Turning to FIG. 5D, lug 204 is now partially positioned across release slot 230; however, lug 204 remains firmly within locking slot 232. With lug 204 still in locking slot 232, locking slot lower shoulder 233 keeps lug support 208 from moving upward, and support spring 212 continues to be fully compressed.

FIG. 5B depicts a cutaway representation of cross section A–A'. Travel joint 200 is still in the locked position, preventing inner mandrel 206 from telescoping into the upper tubing. Lugs 204 still remain firmly between the inner wall of outer mandrel 202 and inner mandrel 206, filling locking slot 232. However, release slot 230 is now visible around the outer diameter of both lugs 204 and lug carrier 210.

FIGS. 6A through 6D depict travel joint 200 in the process of releasing inner mandrel 206. As can be seen from FIG. 6A, lug 204 has been completely received within release slot 230, as will be described more completely with respect to FIG. 6D. Additionally, outer mandrel 202 and pressure block 218 have completed their downward travel, reducing the volume of lower hydraulic chamber 242 to its minimum volume.

However, during the release mode and immediately before lugs 204 disengage from locking slot 232 (not shown in FIG. 6A), hydraulic pressure in lower hydraulic chamber 242 may create an undesirable force between lugs 204 and locking slot 232 that prevents lugs 204 from properly disengaging from locking slot 232. That force may prevent inner mandrel 206 from smoothly unlocking. A corresponding undesirable force occurs during locking mode immediately before lugs 204 disengage from release slot 230 and is also a result of hydraulic pressure in lower hydraulic chamber 242.

Figures 6A, 6B, 6C, 6D:
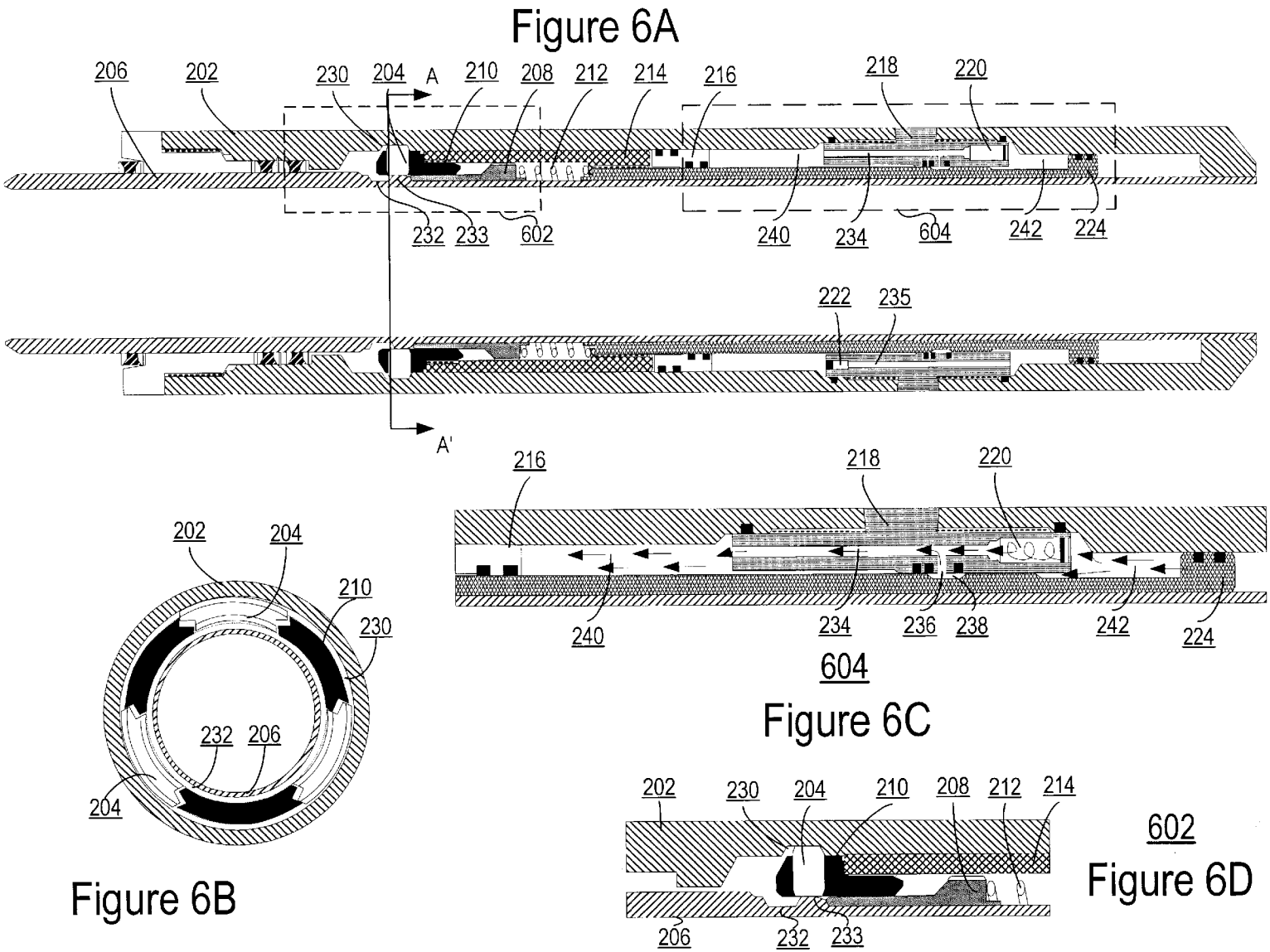
FIGS. 6A through 6D depict a travel joint in the process of releasing an inner mandrel.

To completely free lug 204 during engaging and disengaging and to facilitate locking and unlocking of the travel joint, pressure relief slot 238 is provided in transfer piston 224 and pressure relief port 236 is provided in pressure block 218, as can be seen in FIG. 6C. The hydraulic fluid flows from lower hydraulic chamber 242 through pressure relief slot 238, through pressure relief port 236, and into upper hydraulic chamber 240. The placement of pressure relief slot 238 and pressure relief port 236 allows hydraulic fluid to bleed around pressure relief and restrictor valve 220 and directly into upper hydraulic chamber 240 (as shown by the arrows representing the fluid flow). In the intermediate unlocking position, pressure relief slot 238 is aligned across both pressure relief port 236 and the lowermost o-ring. The hydraulic fluid flows around pressure relief and restrictor value 220 and not across it. In so doing the pressure in lower hydraulic chamber 242 drops below the threshold pressure needed for overcoming pressure relief and restrictor value 220. Therefore, immediately prior to lugs 204 being received into release slot 230 the pressure equalizes between the hydraulic chambers, and the force between lugs 204 and locking slot 232 is relieved. Lug 204 can then be received within release slot 230 as shown in FIG. 6A.

FIG. 6D depicts the engagement/disengagement mechanism depicted in box 602 of FIG. 6A. Turning to FIG. 6D, the continued downward movement of outer mandrel 202 translates into an outward radial force due to the cooperation between the forty five-degree chamfer in locking slot 232 and the corresponding forty five-degree bevel on lug 204. Locking slot lower shoulder 233 forces lug 204 completely into release slot 230. Lug 204 is then held in position by locking slot lower shoulder 233, as outer mandrel 202 continues to move down. The change in relative positions between inner mandrel 206 and lug 204 allows lug support 208 to move upward with respect to lug 204, allowing support spring 212 to partially decompress.

The result of repositioning lugs 204 needed for unlocking is better shown in FIG. 6B, which is a cutaway representation of cross section A–A' shown in FIG. 6A. Travel joint 200 is now in releasing position and, as lugs 204 have been fully received within release slot 230, inner mandrel 206 may now telescope into the upper tubing. Lugs 204 have moved radially outward from the center of travel joint 200 and now are firmly positioned between the outer wall of inner mandrel 206 and the inner wall of outer mandrel 202, filling release slot 230.

Figure 7A:
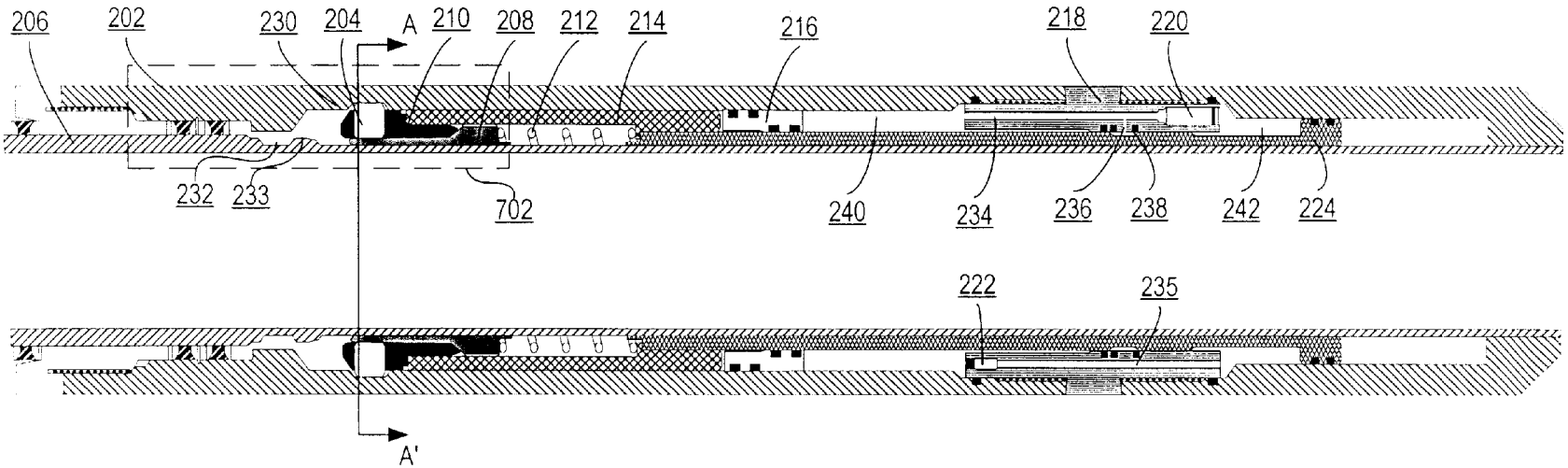
FIGS. 7A through 7C depict a travel joint in the unlocked position and an inner mandrel released.
Figure 7C:
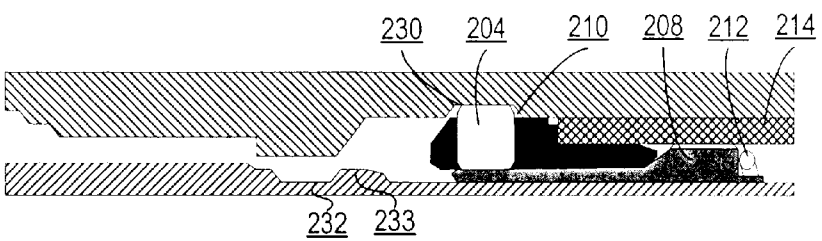
Figure 7B:
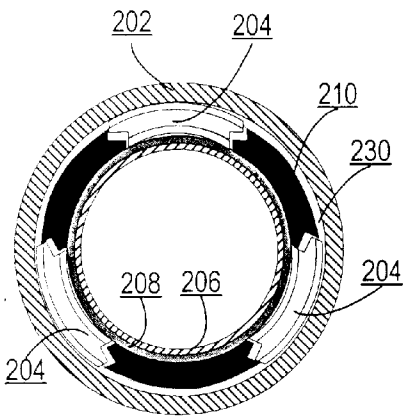

FIGS. 7A through 7C depict travel joint 200 in the unlocked position and inner mandrel 206 released. Referring to FIG. 7A, outer mandrel 202 and pressure block 218 remain in their complete downward positions, having forced the transfer of the hydraulic fluid from lower hydraulic chamber 242 to upper hydraulic chamber 240. The fluid flow was achieved by simultaneously reducing the volume of capacity of lower hydraulic chamber 242 while increasing the volume of upper hydraulic chamber 240 a corresponding amount. Because of the alignment of pressure relief slot 238 and pressure relief port 236, pressure between the upper and lower hydraulic chambers has been equalized.

As can be seen in FIG. 7A, inner mandrel 202 is now free to telescope within travel joint 200. Locking slot lower shoulder 233 has moved upward with respect to lug 204, allowing lug support 208 to reposition itself under both lug 204 and lug carrier 210, from upward force provided by the decompression of support spring 212. The fully locked position of lug support 208 is better realized by viewing FIGS. 7B and 7C. FIG. 7B, which is a cutaway representation of cross section A–A' shown in FIG. 7A. Travel joint 200 is now in the fully released position and lugs 204 have been fully received within release slot 230. Lugs 204 are extended radially outward and now are firmly positioned between the inner wall of outer mandrel 202 and the outer wall of lug support 208, filling release slot 230.

FIG. 7B depicts a magnified view of block 702 shown in FIG. 7A showing a side view of release slot 230 fully receiving locking lug 204. Inner mandrel 206 has been unlocked allowing inner mandrel 206 to slide free of locking lug 204. Locking slot 232 and locking slot lower shoulder 233 has moved upward with respect to lug 204, allowing lug support 208 under both lug 204 and lug carrier 210.

In accordance with a preferred embodiment of the present invention, releasing travel joint 200 requires the well operator to apply a set compressive force across the traveling joint for a fixed time interval. This procedure ensures that travel joint 200 does not become prematurely unlocked while tripping into the wellbore. An equally important aspect of the present invention is that once unlocked, travel joint 200 can be re-locked with minimal tension applied across the travel joint. In most cases, the tension needed to lock travel joint 200 is a force only slightly higher than that needed to compress support spring 212, overcome the friction of the internal seals, and overcome the minimal hydraulic resistance of the check valve.

FIGS. 8 through 10 depict the locking operation in accordance with a preferred embodiment of the present invention. The locking operation is largely the reverse of the unlocking operation described above with some exceptions. Those exceptions are stressed below. Initially, the tubing string is pulled upward, causing a slight compressive force across travel joint 200.

Figure 8A:
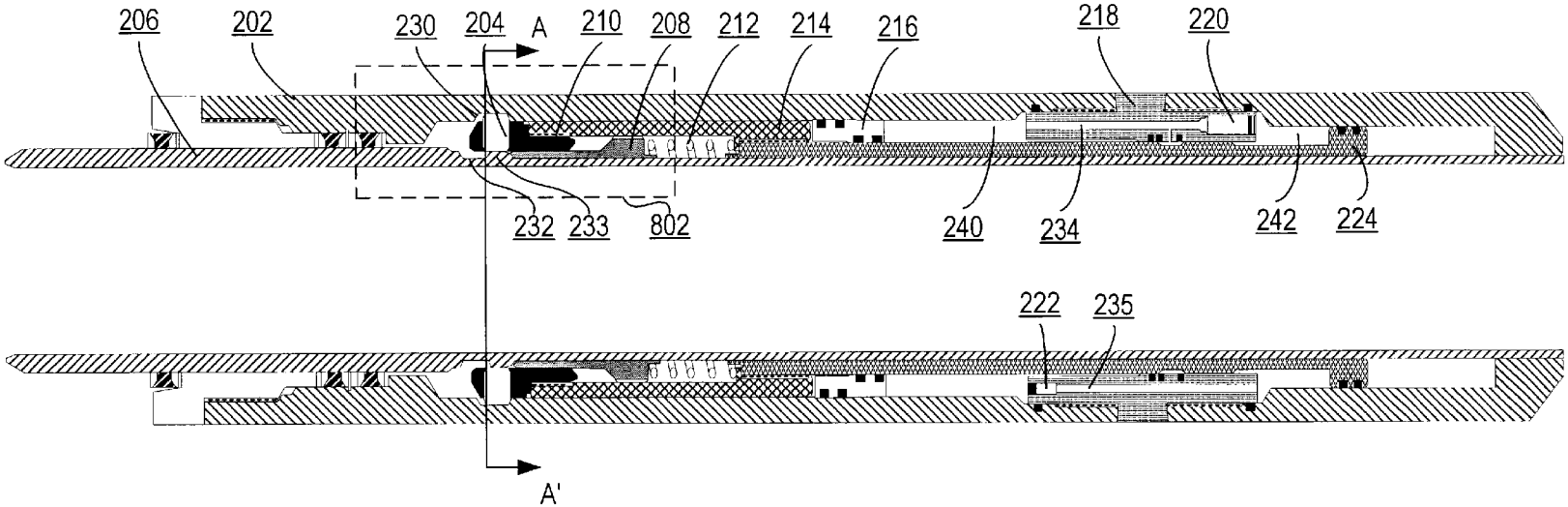
FIGS. 8A through 8C show a lug remaining positioned within a release slot as a travel joint is moved upward with respect to an inner mandrel.

Referring now to FIG. 8A, lug 204 remains positioned within release slot 230 as travel joint 200 is moved upward with respect to inner mandrel 206. At some point, locking slot lower shoulder 233 contacts lug support 208 and stops lug support 208 from continuing its upward movement. Support spring 212 is then compressed between lug support 208 and transfer piston 224, as the transfer piston continues to move up with outer mandrel 202.

Figure 8C:
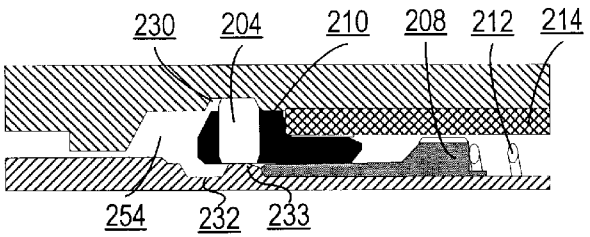

FIG. 8C depicts the engagement/disengagement mechanism depicted in box 802 of FIG. 8A. Lugs 204 remain on locking slot lower shoulder 233 until the alignment with locking slot 232 is completed.

Figure 8B:
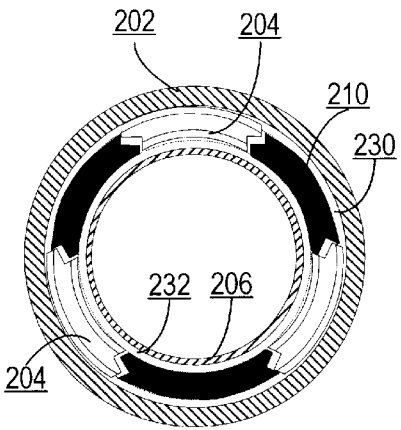

The repositioning of locking slot lower shoulder 233 with respect to lugs 204 is shown in FIG. 8B, which is a cutaway representation of cross section A–A' shown in FIG. 8A.

There the outer surfaces of lugs 204 remain firmly in release slot 230, however, the inner surfaces are positioned over a portion of locking slot 232. Once lugs 204 align completely with locking slot 232, the lugs will disengage release slot 230 and re-engage locking slot 232.

Figure 9A:
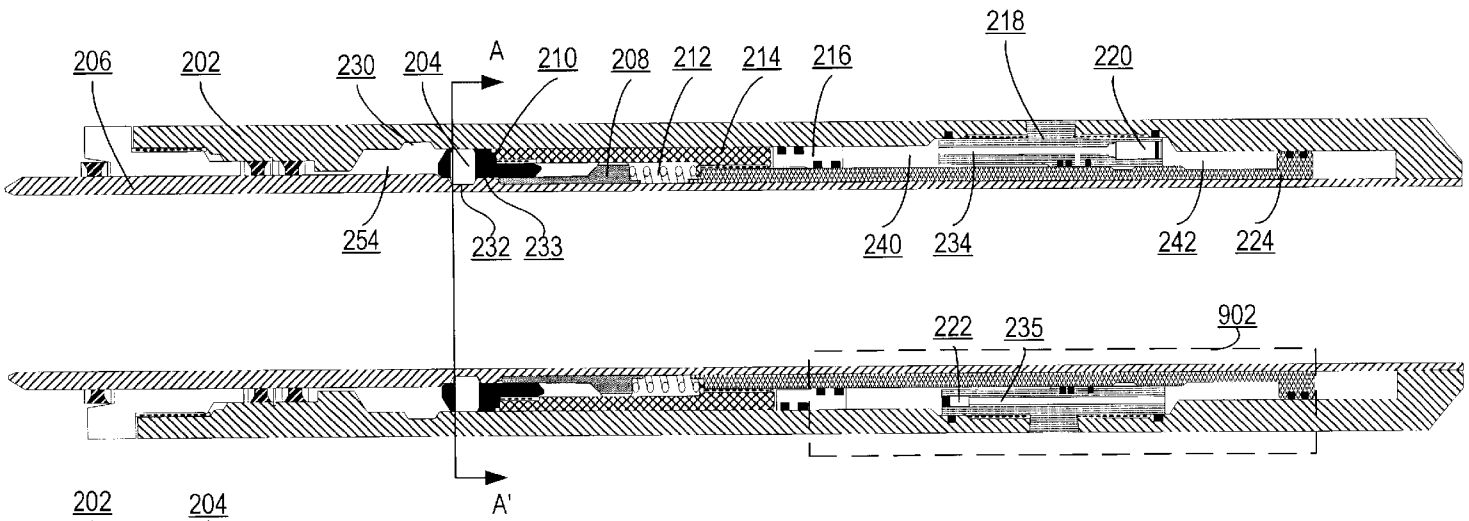
FIGS. 9A through 9C depict an intermediate locking position for a travel joint.
Figure 9C:
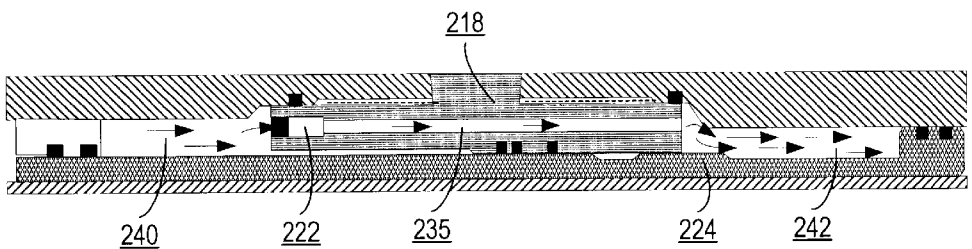
Figure 9B:
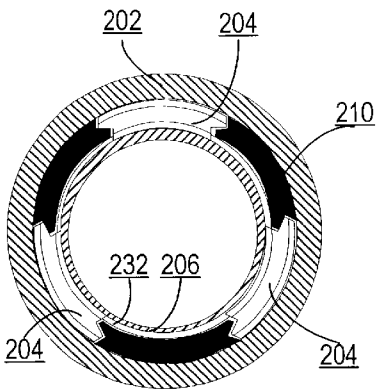

FIGS. 9A through 9C depict an intermediate locking position for travel joint 200. Eventually the upward movement of outer mandrel 202 moves lug 204 past lower shoulder 233 and lugs 204 align with locking slot 232. The upward force is translated into an inward radial force on lugs 204 due to the cooperation between the forty five-degree chamfer in release slot 230 and the corresponding forty five-degree bevel on lug 204. Lug 204 is received within locking slot 232. Simultaneously, lug support 208 rides below locking slot lower shoulder 233, fully compressing support spring 212.

Once lugs 204 have seated into locking slot 232, the force needed from completing the locking operation may be somewhat reduced because support spring 212 is fully compressed and locked in place. The entire upward force is then applied across the engaging/disengaging assembly (lug 204, lug carrier 210, lug carrier connector 214, transfer piston 224, and floating piston 216).

The repositioning of locking slot lower shoulder 233 with respect to lugs 204 needed for re-locking is shown in FIG. 9B, which is a cutaway representation of cross section A–A' shown in FIG. 9A. Travel joint 200 is in another intermediate locked position where lugs 204 have been fully received within locking slot 232, but traveling piston 224 has not been fully reset. Lugs 204 have moved radially inward from the circumference of travel joint 200 and now are firmly positioned between the outer wall of inner mandrel 206 and outer mandrel 202, filling locking slot 232.

Turning to FIG. 9C, the path of hydraulic fluid through pressure block 218 is depicted. As discussed above, the pressures within upper hydraulic chamber 240 and lower hydraulic chamber 242 is approximately equal, allowing for the hydraulic fluid to flow from the upper chamber to the lower chamber via check valve 222 and lock hydraulic channel 235, as indicated by the arrows. Again, because the hydraulic fluid traverses check valve 222, rather than a pressure relief and restrictor valve, locking travel joint 200 takes relatively little force. Equally important is the fact that, once any hydraulic fluid is transferred into lower hydraulic chamber 242, travel joint 200 can only be unlocked by providing a sufficient force across the travel joint to overcome the threshold pressure associated with pressure relief and restrictor valve 220 (shown in FIG. 9A). The threshold pressure is independent of the amount of fluid in the lower chamber or the position of the pistons, provided lug 204 is not aligned with release slot 230.

Figure 10A:
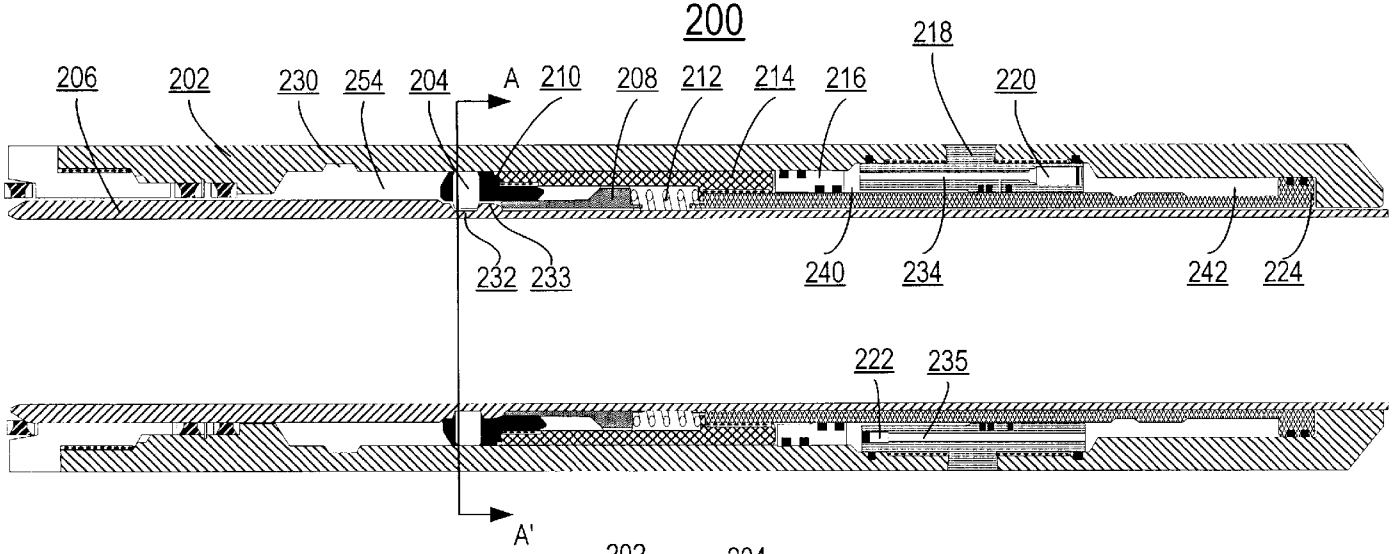
FIGS. 10A and 10B illustrate a travel joint in the fully locked position.
Figure 10B:
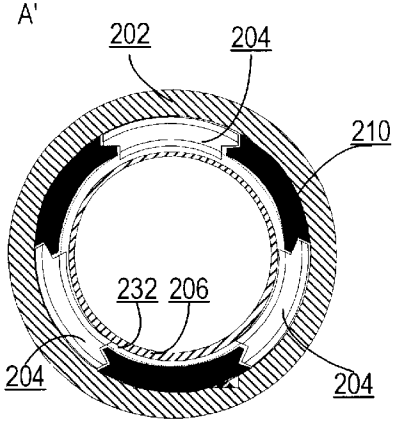

FIGS. 10A and 10B illustrate travel joint 200 in the fully locked position. At some point, outer mandrel 202 reaches its uppermost position with respect to the remaining components in travel joint 200. At that point, floating piston 216 and transfer piston 224 are at their lowermost position with respect to outer mandrel 202, and the flow of hydraulic fluid through check valve 222 and locking hydraulic channel 235 ceases. The pressures within upper hydraulic chamber 240 and lower hydraulic chamber 242 are approximately equal. Lower hydraulic chamber 242 now is fully expanded and contains the maximum possible volume of hydraulic fluid, while upper hydraulic chamber 240 is fully contracted and contains only the minimum possible volume of hydraulic fluid.

Lugs 204 are completely seated within locking slot 232, as can be seen in FIG. 10A or in cutaway section A–A' shown in FIG. 10B. Lug carrier 210 is situated between the interior diameter of outer mandrel 202 and the exterior diameter of inner mandrel 206, and lugs 204 are radially disposed between lug grooves formed in lug carrier 210. Lug support 208 is pressed firmly against locking slot lower shoulder 233 due to support spring 212 being in the fully compressed position, which exerts the maximum upward force possible.

FIG. 10B is a diagram showing a radial cutaway view taken at section A–A'. Travel joint 200 is in the fully locked position. Lugs 204 are firmly between the inner wall of outer mandrel 202 and outer wall of inner mandrel 206, filling locking slot 232.

As discussed above, the hydraulically metered travel joint disclosed herewithin has several distinct advantages over prior art travel joints, allowing the present travel joint to be used in even the most rigorous wellbore environments. An important feature of the present invention is that the unlocking or release mechanism is hydraulically metered. Force applied to the tubing is translated into hydraulic pressure, and the unlocking activation process commences when the hydraulic pressure exceeds a preset threshold. An important feature of the present invention is that the hydraulically metered travel joint is configurable to different wellbore environments. Both the threshold pressure and activation time interval can be preset. The process of locking the travel joint merely entails reversing the direction of movement and requires little force to be applied across the travel joint.

Figure 11A:
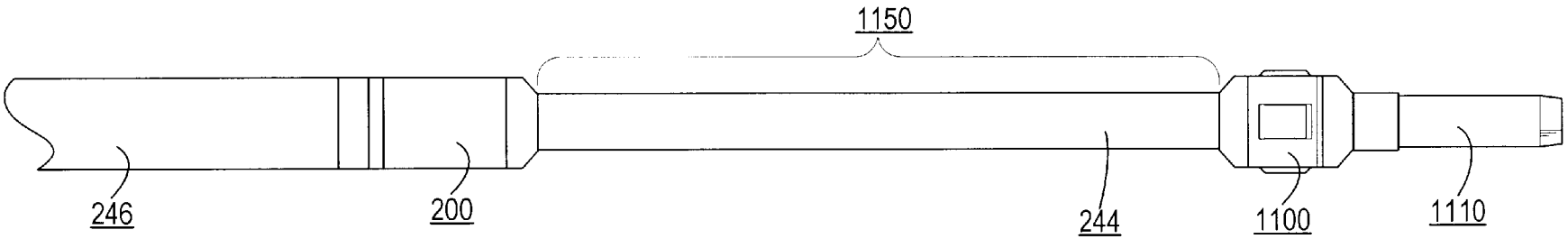
FIG. 11A is a are diagrams depicting the use of a drag block in combination with a hydraulically metered travel joint.

FIG. 11A is a diagram depicting the use of a drag block in combination with a hydraulically metered travel joint. Here a bottom hole assembly includes upper tubing 246, travel joint 200, lower tubing 244, and packer stinger 1110. As discussed above, in this configuration a typical operation might involve stinging into a downhole packer with stinger 1110 and then applying sufficient compressional pressure across travel joint 200 such that the hydraulic pressure in the lower hydraulic chamber exceeds the threshold pressure needed for initiating the locking. The hydraulic fluid would then flow from the lower hydraulic chamber into the upper hydraulic chamber at a predetermined rate, eventually allowing the inner mandrel to smoothly unlock from the upper mandrel. The inner mandrel can then be telescoped into the outer mandrel, thereby spacing out the tubing length between the tubing hanger and stinger 1110.

Also depicted in FIG. 11A is drag block 1100, which may be included in the bottom hole assembly for increasing drag resistance for resetting travel joint 200 in highly deviated or horizontal wellbores. When running travel joint 200 through a tight spot or restriction in a wellbore, the tubing weight needed for traversing the restriction might increase the compressional pressure across travel joint 200 in excess of the force needed for initiates the unlocking process. While this condition would be catastrophic for prior art shear pin type travel joints, an important aspect of the present invention is that unlocking requires the application of a predetermined compressional pressure, over a preset time period. The preset time period is determined by metering the flow rate of hydraulic fluid. Therefore, a well operator has the option of working a tubing string past a tight spot by exceeding the tubing weight needed for unlocking travel joint 200, provided the cumulative time that the tubing weight exceeds the unlocking pressure does not exceed the preset time period. However, once travel joint 200 has passed the tight spot, the travel joint should be reset, thereby resetting the time period needed for unlocking. The tension needed to reset travel joint 200 is a force only slightly higher than that needed to compress the support spring, overcome the friction of the internal seals, and overcome the minimal hydraulic resistance of the check valve. In many cases the tension needed for resetting travel joint 200 is less the combined weight of lower tubing 244 and stinger 1110. However, in horizontal or highly deviated wellbores the tension created by the weight of the lower tubing and stinger is not sufficient to reset the travel joint. In that case, drag block 1100 is included in the string, which creates drag below travel joint 200 and enables the well operator to reset travel joint 200 by merely pulling up on the tubing string. Note, however, that the inclusion of drag block 1100 reduces stroke length 1150 for travel joint 200 because drag block 1100 cannot be telescoped within travel joint 200. Therefore, the placement of drag block 1100 should allow for stroke length 1150 sufficient for the well application.

Figure 11B:
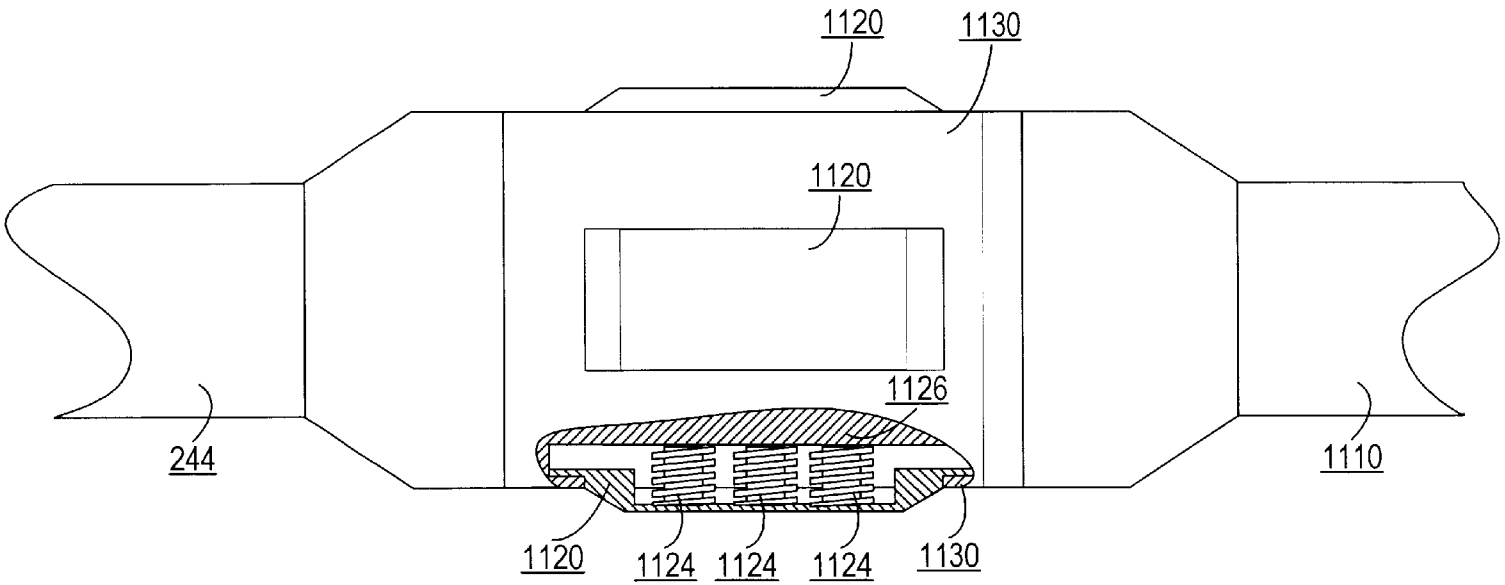
FIG. 11B is a cutaway diagram of drag block 1100.

FIG. 11B is a cutaway diagram of drag block 1100. Drag block 1100 is positioned between lower tubing 244 and stinger 1110. Drag is created against the inner wall of a wellbore by frictional force created by a plurality of drag shoes 1120 held in position by outer housing 1130. The frictional force created from drag shoes 1120 may be considerable, therefore drag shoes 1120 are composed of a hardened metal such as carbide steel or the like. The force needed for keeping drag shoes 1120 against the inner wellbore wall and creating the drag friction is provided by a plurality of high tension springs 1124 affixed between drag shoes 1120 and inner housing 1126. While drag block 1100 is a preferred embodiment of a drag producing device, those skilled in the art would realize that other drag producing devices exist such as bow springs or drag spring and the like.

Figure 12:
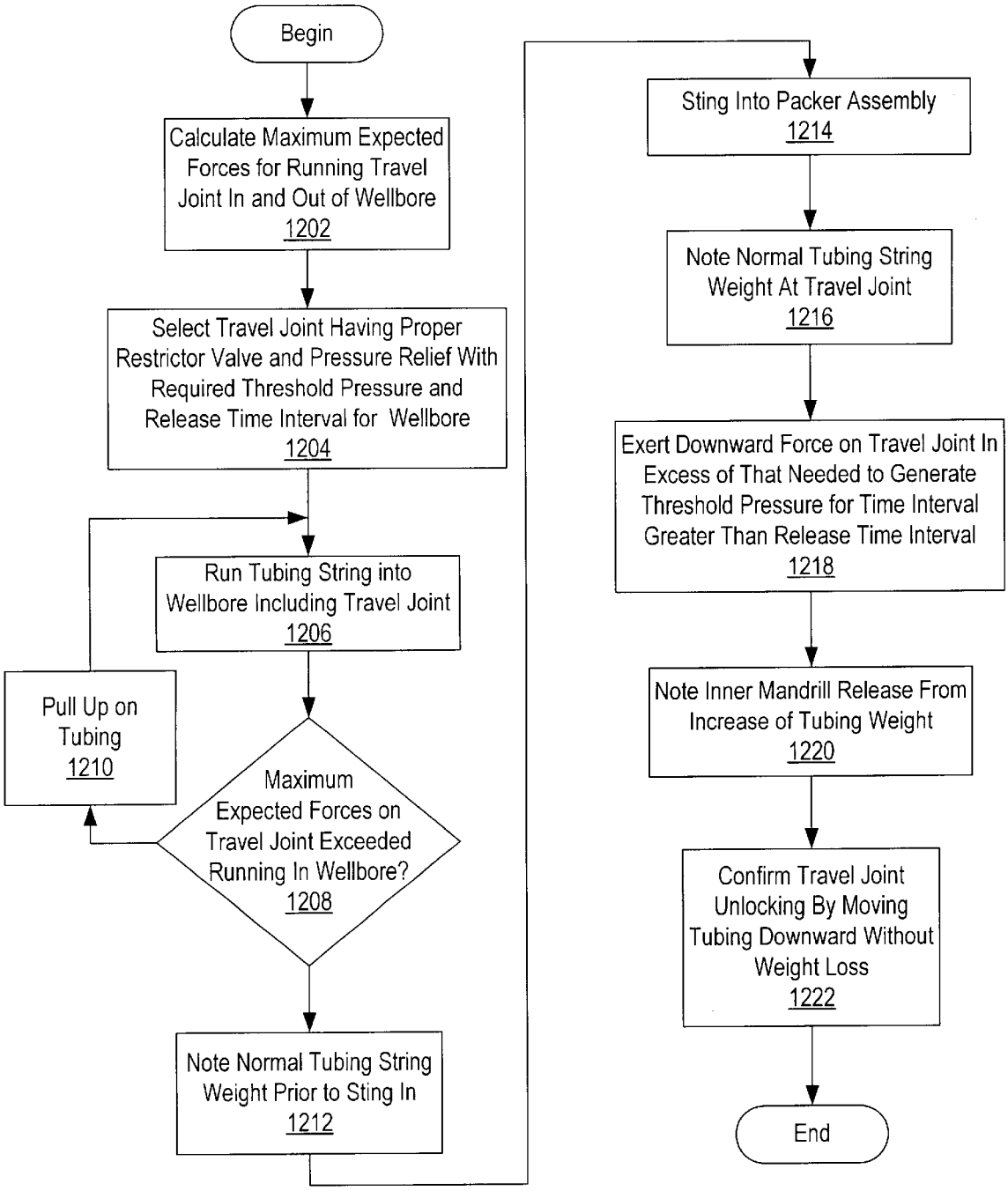
FIG. 12 depicts a process for locking and unlocking a hydraulically metered travel joint in accordance with a preferred embodiment of the present invention.
Figure 13:
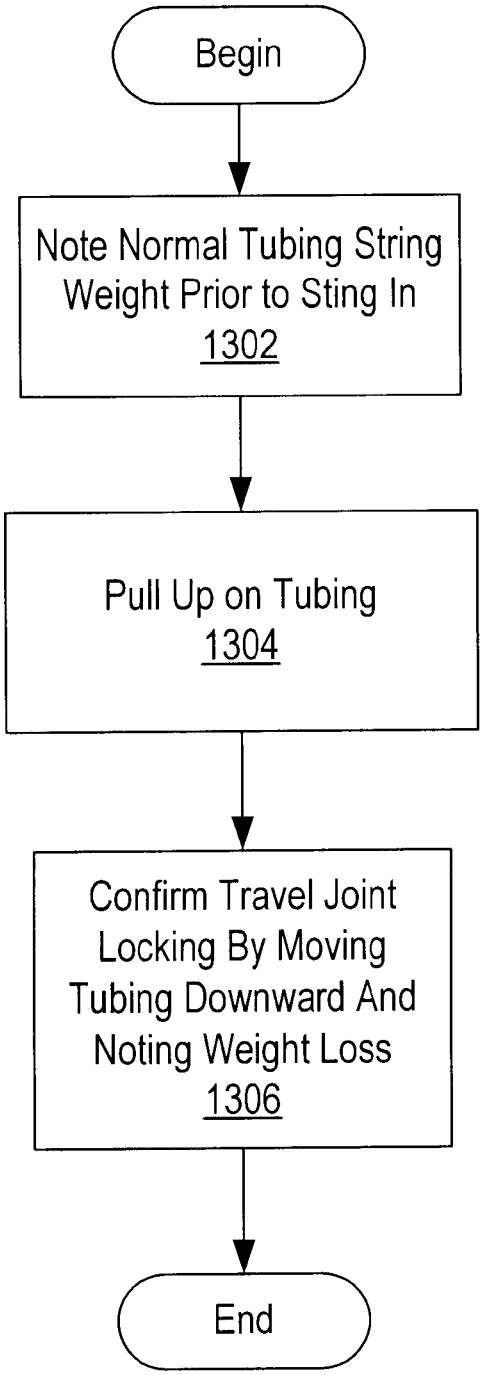
FIG. 13 depicts the process for re-locking the travel joint.

FIGS. 12 and 13 depict a process for locking and unlocking a hydraulically metered travel joint in accordance with a preferred embodiment of the present invention. The process begins by calculating the maximum force expected to be encountered while running the travel joint in the well (step 1202). Generally, the higher the wellbore deviation, the deeper the wellbore; and the more corkscrews or doglegs, the more force will be needed in order to run the tubing in the well. By knowing how much force is needed for running the tubing past a tight spot in the well, an appropriate travel joint for the well can be selected. The appropriateness of the travel joint is based on the ratings of the pressure relief and restrictor valve. The valve ratings must correspond to both the required threshold pressure rating and the desired preset release time period necessary for successfully running the tubing in the well without prematurely unlocking (step 1204). The tubing, including the travel joint, is then run into the wellbore (step 1206). Next, as the tubing is being run into the wellbore, the force needed to get the tubing to the bottom is constantly monitored. A determination is made as to whether the maximum expected forces on the travel joint have been exceeded running in wellbore (step 1208). If so, the tubing is immediately backed off, or pulled up slightly, allowing the hydraulic section of the travel joint to return to a fully locked position (step 1210). Importantly, the present travel joint does not instantaneously unlock once the threshold pressure has been exceeded. Instead, the threshold pressure must be maintained for a preset time period, however, the time period is cumulative. Therefore, in extreme wellbore conditions, the threshold pressure may be exceeded any number of times without fear of pre-mature unlocking, as long as the cumulative time for exceeding the threshold pressure does not exceed the preset time period. Still more importantly, after the threshold pressure has been exceeded for a time period, the travel joint can be pulled up a short distance in the wellbore, which resets the cumulative time interval (in highly deviated wellbores a drag block may be needed for generating the force needed to reset the travel joint). Those of ordinary skill in the art will realize that an important benefit of the present invention allows a well operator the flexibility to "push" the tubing past a tight spot and, once having completely cleared the tight spot, pull up on the tubing, which re-starts the cumulative time interval. The travel joint is thus reset for the next tight spot and continues to be run into the wellbore (step 1208). The iterations of pushing past tight spots and re-starting the cumulative time interval continue until the tubing nears the packer. The well operator then notes the normal tubing weight prior to stinging into the packer (step 1212), stings into the packer (step 1214), and calculates the normal tubing string weight at the travel joint (step 1216). Next, downward force is exerted on the travel joint in excess of that needed to generate threshold pressure. The force is maintained for a cumulative time interval greater than the preset release time interval (step 1218). From the surface weight indicator, the well operator should be able to see a slight increase in tubing weight, indicating that the inner mandrel is released from the travel joint (step 1220). The tubing weight should be approximately equal to the calculated normal tubing string weight at the travel joint. Confirmation that the travel joint is unlocking is obtained by moving tubing downward without tubing weight loss (step 1222).

FIG. 13 depicts the process for re-locking the travel joint. The process begins by calculating the normal tubing string weight at the travel joint (step 1302). The well operator then pulls up on the tubing, which engages the locking lugs and resets the hydraulic section (step 1304). The travel joint immediately locks, unlike unlocking, which is time-delayed. Confirmation that the travel joint is locking is obtained by the surface tubing weight dropping below the calculated normal tubing weight when tubing is slightly lowered (step 1306).

Although preferred embodiments of the present invention have been described in the foregoing detailed description and illustrated in the accompanying drawings, it will be understood that the invention is not limited to the embodiments disclosed but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

We claim:

1. A method of activating a travel joint, comprising the steps of:

connecting a travel joint, having an inner mandrel, to a tubing string;

running the travel joint in a wellbore;

applying a longitudinal force across the travel joint, whereby a hydraulic pressure is generated within the travel joint which is greater than a preset threshold pressure value;

using the generated hydraulic pressure to unlock said inner mandrel; and telescoping the inner mandrel within an upper tubing string;

wherein said inner mandrel can be repeatedly locked and unlocked with respect to said travel joint without redressing said travel joint.

2. The method recited in claim 1, wherein said step of applying the longitudinal force further comprises maintaining the longitudinal force for a time period greater than a preset time period.

3. The method recited in claim 1, prior to connecting the travel joint to a tubing string, the method further comprises:

calculating expected force needed for running the tubing string into the wellbore; and selecting a travel joint having a pressure relief and restrictor valve with attributes which correspond to the expected force needed for running the tubing string into the well.

4. The method recited in claim 3 further comprises:

selecting the travel joint having a pressure relief and restrictor valve with attributes which correspond to a preset time period.

5. The method recited in claim 4, prior to applying a longitudinal force across the travel joint, the method further comprises:

encountering a section of wellbore requiring a force greater than the expected force needed for running the tubing string into the wellbore; and applying a force greater than the expected force needed for running the tubing string past the section of wellbore, wherein the force greater than the expected force is applied for a cumulative time period which is less than the preset time period.

6. The method recited in claim 1, prior to unlocking the inner mandrel, the method comprises:

moving an outer mandrel of said travel joint, wherein the outer mandrel comprises a release slot;

aligning the release slot with a locking lug located between an outer surface of said inner mandrel and an inner surface of said outer mandrel; and receiving the locking lug within the release slot.

7. The method recited in claim 1 further comprises:

pulling up on the tubing spring, wherein the tubing string is further connected to an outer mandrel portion of the travel joint; and repositioning the outer mandrel relative to the inner mandrel, wherein a quantity of hydraulic fluid is transferred from a first chamber to a second chamber in response to the repositioning.

8. A method of activating a travel joint, having an inner mandrel, comprising the steps of:

connecting a travel joint, having an inner mandrel, to a tubing string;

running the travel joint in a wellbore;

applying a longitudinal force across the travel joint, whereby a hydraulic pressure is generated within the travel joint which is greater than a preset threshold pressure value;

using the generated hydraulic pressure to unlock said inner mandrel;

telescoping the inner mandrel within an upper tubing string; and restarting the time period by pulling up on the tubing;

wherein said inner mandrel can be repeatedly locked and unlocked with respect to said travel joint without redressing said travel joint.

9. A method of activating a travel joint, comprising the steps of:

connecting a travel joint, having an inner mandrel, to a tubing string;

running the travel joint in a wellbore;

applying a longitudinal force across the travel joint, whereby a hydraulic pressure is generated within the travel joint which is greater than a preset threshold pressure value;

using the generated hydraulic pressure to unlock said inner mandrel;

telescoping the inner mandrel within an upper tubing string;

pulling up on the tubing spring, wherein the tubing string is further connected to an outer mandrel portion of the travel joint;

repositioning the outer mandrel relative to the inner mandrel, wherein a quantity of hydraulic fluid is transferred from a first chamber to a second chamber in response to the repositioning;

wherein the inner mandrel further comprises a locking slot, and prior to re-locking the inner mandrel, the method further comprises:

moving the outer mandrel, wherein the outer mandrel further comprises a release slot having a locking lug engaged within the release slot;

aligning the locking lug with the locking slot;

receiving the locking lug within the locking slot; and re-locking the inner mandrel.

* * * * *